US011788530B2

(12) United States Patent
Hu et al.

(10) Patent No.: US 11,788,530 B2
(45) Date of Patent: Oct. 17, 2023

(54) PISTON LIMITING STRUCTURE, COMPRESSOR, AND HEAT EXCHANGE APPARATUS

(71) Applicant: Gree Electric Appliances, Inc. of Zhuhai, Guangdong (CN)

(72) Inventors: Yusheng Hu, Guangdong (CN); Huijun Wei, Guangdong (CN); Jia Xu, Guangdong (CN); Zhongcheng Du, Guangdong (CN); Sen Yang, Guangdong (CN); Zhi Li, Guangdong (CN); Liping Ren, Guangdong (CN); Shebing Ren, Guangdong (CN); Shebing Liang, Guangdong (CN); Rongting Zhang, Guangdong (CN); Zhengliang Shi, Guangdong (CN); Ning Ding, Guangdong (CN); Shuang Guo, Guangdong (CN); Liping Liao, Guangdong (CN)

(73) Assignee: GREE ELECTRIC APPLICANCES, INC. OF ZHUHAI, Guangdong (CN)

( * ) Notice: Subject to any disclaimer, the term of this patent is extended or adjusted under 35 U.S.C. 154(b) by 179 days.

(21) Appl. No.: 17/283,004

(22) PCT Filed: Sep. 9, 2019

(86) PCT No.: PCT/CN2019/106724
§ 371 (c)(1),
(2) Date: Apr. 5, 2021

(87) PCT Pub. No.: WO2020/125099
PCT Pub. Date: Jun. 25, 2020

(65) Prior Publication Data

US 2021/0348610 A1 Nov. 11, 2021

(30) Foreign Application Priority Data

Dec. 18, 2018 (CN) ..... 201811549125.4

(51) Int. Cl.
*F04C 18/344* (2006.01)
*F04C 29/04* (2006.01)

(52) U.S. Cl.
CPC ..... *F04C 18/344* (2013.01); *F04C 29/04* (2013.01); *F04C 2270/17* (2013.01)

(58) Field of Classification Search
CPC .. F04C 2240/60; F04C 2240/30; F04C 29/00; F04B 29/00; F01C 21/0809
See application file for complete search history.

(56) References Cited

U.S. PATENT DOCUMENTS 2,303,969 A 12/1942 Wiken

FOREIGN PATENT DOCUMENTS

CN 106065854 A 11/2016
CN 205895526 U 1/2017
(Continued)

OTHER PUBLICATIONS

English Translation of CN 106065854 B (Year: 2017).*
(Continued)

*Primary Examiner* — Anthony Ayala Delgado
(74) *Attorney, Agent, or Firm* — Dennemeyer & Associates LLC; Victoria Friedman

(57) ABSTRACT

Some embodiments of a disclosure provide a piston limiting structure, a compressor, and a heat exchange apparatus. The piston limiting structure includes: a cylinder, having a piston hole perpendicular to an axial direction of the cylinder and penetrating the cylinder, wherein a projection of the piston hole in a penetrating direction is circular; a piston, disposed in the piston hole and slid in the piston hole, wherein a side wall of the piston is provided with a limiting surface, and the limiting surface does not penetrate two ends of the side wall of the piston along an axial length of the piston; and a limiting member, wherein the cylinder is provided with a
(Continued)

limiting hole penetrating from an outer wall of the cylinder to the piston hole, the limiting member is mounted in the limiting hole, and the limiting member abuts against the limiting surface.

19 Claims, 9 Drawing Sheets

(56) References Cited

FOREIGN PATENT DOCUMENTS

| | | | | |
|---|---|---|---|---|
| CN | 106065854 | B | * | 11/2017 |
| CN | 109555690 | A | | 4/2019 |
| CN | 109555694 | A | | 4/2019 |
| CN | 109555695 | A | | 4/2019 |
| JP | 10281052 | A | | 10/1998 |

OTHER PUBLICATIONS

International Search Report issued in connection with PCT Application No. PCT/CN2019/106724 dated Dec. 20, 2019.
Search report for EP application No. 19898508.7 dated Dec. 10, 2021.

* cited by examiner

PISTON LIMITING STRUCTURE, COMPRESSOR, AND HEAT EXCHANGE APPARATUS

CROSS-REFERENCE TO RELATED APPLICATION(S)

The present disclosure is a national stage application of International Patent Application No. PCT/CN2019/106724, which is filed on Sep. 19, 2019. The International Patent Application claims priority to Chinese Patent Application No. 201811549125.4, filed on Dec. 18, 2018 and entitled "Piston Limiting Structure, Compressor and Heat Exchange Apparatus", the disclosure of which is hereby incorporated by reference in its entirety.

TECHNICAL FIELD

The disclosure relates to the field of compressors, and in particular to a piston limiting structure, a compressor, and a heat exchange apparatus.

BACKGROUND

A rotary cylinder piston compressor is a compressor based on a crosshead shoe principle, a cylinder thereof is rotated in a cylinder sleeve, a piston is arranged transversely in a piston hole of the cylinder, and reciprocated to be slid in the piston hole, thereby a compression chamber is formed among an end face of the piston, a side wall of the piston hole and an inner wall of the cylinder sleeve.

In order to guarantee fit degree and applicability between the piston and the piston hole, from a manufacturing perspective, applying a circular piston hole and a piston with a cylindrical cross section is apparently the best, and it is the easiest to guarantee the machining accuracy. However, in this case, because the piston hole is arranged transversely in the cylindrical piston, two end edges of the piston hole are actually intersecting lines of two cylinders, a length along a circumferential direction everywhere is varied continuously. Similarly, two end edges of the piston are also intersecting lines of the two cylinders (i.e. consistent with the two end edges of the piston hole), and a length of the piston along a circumferential direction thereof everywhere is also varied continuously. In an ideal state, a bus of a piston head (namely an end face) should be parallel to a bus of an outer surface of the cylinder, so that a destination of a reciprocating motion of the piston perfectly fits the inner wall of the cylinder sleeve (namely the end face of the piston and the outer surface of the cylinder form a completed cylindrical surface) to complete the exhaust. However, in fact, while the piston with the circular cross section is applied, the piston is auto-rotated relative to the cylinder during an operation process, because the lengths of the piston and the piston hole along the circumferential direction everywhere are both varied continuously, once the relative rotation is generated between two parties, the completed cylindrical surface may not be formed by the end face of the piston and the outer surface of the cylinder, the interference between the head of the piston and the inner wall of the cylinder sleeve is caused in a compression process of the piston, so that the collision to the cylinder is generated.

In order to solve a problem that the collision to the cylinder is generated by the circular piston, the rotary cylinder piston compressor is improved by using two solutions in the art known to inventors.

I. A non-circular piston is used, and the piston hole of the cylinder also needs to be correspondingly set as a non-circular shape, a non-circular structure is poor in machining manufacturability, harmful to large-scale production, and difficult to machine and guarantee the accuracy. In addition, there are multiple matching sizes for a matching surface of the piston and the cylinder, for example, outer diameters of two non-circular sections, a center distance of a semi-circular arc surface, a length of a parallel segment, and a width of the piston, it is difficult to simultaneously guarantee a matching clearance between the piston and the cylinder in an assembly process, the assembly and performance of the compressor are affected. In addition, the parallel segment of the non-circular piston has a larger deformation during actual operation, a reliability of the compressor is affected.

II. A limiting structure is additionally axially arranged on the circular piston, and thereby the auto-rotation of the piston is limited. Specifically, an axial surface of the circular piston is provided with a pin, and a corresponding position of the piston hole of the cylinder is provided with a through pin avoidance groove, the piston is limited by the pin and the avoidance groove, so that the piston is prevented from being rotated. However, in such a solution, although the piston is the circular piston, the corresponding piston hole is actually non-circular due to the arrangement of the through avoidance groove, and the avoidance groove is cooperated with the pin, so that an end portion of the avoidance groove is located at an air suction-exhaust chamber, an air suction-exhaust process of a pump body is affected, and a natural clearance volume is introduced at a terminal end of compression. In addition, the cooperation of the pin and the avoidance groove is located between two compression chambers, and it needs to be guaranteed that two chamber bodies are sealed, thereby it belongs to a finish machining position, a machining process, such as linear cutting, specially harmful to the large-scale production is still necessary to be used for the cylinder. Therefore, how to solve the cylinder collision problem of the circular piston becomes a research direction for improving the rotary cylinder piston compressor.

SUMMARY

In order to solve technical problems in the art known to inventors that a circular piston revolves on its own axis to cause interference between a piston head and an inner wall of a cylinder sleeve or even collision to a cylinder, and a limiting structure between the circular piston and the cylinder introduces a natural clearance volume, some embodiments of the disclosure provide a piston limiting structure with high cooperation accuracy and capable of preventing the piston from rotating on its own axis without introducing a clearance volume.

At the same time, in order to solve technical problems that a limiting structure of a circular piston in a rotary cylinder piston compressor may introduce a clearance volume and is high in machining process requirements, some embodiments of the disclosure provide a compressor using a circular piston without introducing a clearance volume.

In some embodiments, in order to solve technical problems similar to the above technical problems, the disclosure further provides a heat exchange apparatus.

Some embodiments of the disclosure provide a piston limiting structure, including: a cylinder, having a piston hole perpendicular to an axial direction of the cylinder and penetrating the cylinder, wherein a projection of the piston hole in a penetrating direction is circular;

a piston, disposed in the piston hole in a form-fit manner and slid in the piston hole in a reciprocating manner, wherein a side wall of the piston is provided with a limiting surface, and the limiting surface does not penetrate two ends of the side wall of the piston along an axial length of the piston; and a limiting member, wherein the cylinder is provided with a limiting hole penetrating from an outer wall of the cylinder to the piston hole, the limiting member is mounted in the limiting hole in the form-fit manner, and the limiting member abuts against the limiting surface to limit a rotation of the piston around an axis of the piston itself.

In some embodiments, the limiting hole penetrates from an end face of the cylinder to the piston hole and is parallel to an axial direction of the cylinder.

In some embodiments, a position of the limiting hole on the cylinder corresponds to a position of ½ of an axial length of the piston hole.

In some embodiments, while the piston is reciprocated to be slid in the piston hole, it is satisfied:

$$L1-L2 \geq S$$

wherein, the L1 is a length of the limiting surface along the axial direction of the piston, the L2 is a length of the limiting member along the axial direction of the piston, and the S is a stroke of the piston slid in the cylinder.

In some embodiments, the limiting surface is a plane, wherein the limiting surface is disposed in a position of ½ of a radial height direction of the piston.

In some embodiments, while the limiting member abuts against the limiting surface, it is satisfied:

$$\frac{D_1 + D_2}{2} > L$$

wherein, the D1 is a diameter of a projection of the piston in the axial direction, the D2 is a length of the limiting member in a radial direction of the piston, and the L is a length from a center of the limiting member in the radial direction of the piston to a center of the piston.

In some embodiments, while the limiting member abuts against the limiting surface, it is satisfied:

$$L > \frac{D_1 - D_2}{2}$$

wherein, the D1 is the diameter of the projection of the piston along the axial direction, the D2 is the length of the limiting member in the radial direction of the piston, and the L is the length from the center of the limiting member in the radial direction of the piston to the center of the piston.

In some embodiments, the limiting hole is extended to a position of ½ of an axial height of the cylinder from the end face of the cylinder.

In some embodiments, the number of the limiting hole is one, and it is disposed on an upper end face or a lower end face of the cylinder.

In some embodiments, the number of the limiting holes is two, the two limiting holes are disposed on an upper end face of the cylinder and positioned at two sides of an axis of the cylinder, or the two limiting holes are disposed on a lower end face and positioned at the two sides of an axis of the cylinder, or one of the two limiting holes is disposed on an upper end face of the cylinder and positioned at one side of the axis of the cylinder, and the other is disposed on a lower end face of the cylinder and positioned at the other side of the axis of the cylinder.

In some embodiments, the limiting hole penetrates through the cylinder, and is disposed in at least one side of two sides of the axis of the cylinder.

In some embodiments, the limiting member is a cylindrical limiting pin.

Some embodiments of the disclosure further provide a compressor, including: a rotation shaft; the above piston limiting structure, wherein the cylinder and the piston are provided with shaft holes penetrating along an axial direction of the cylinder, the shaft holes are used for mounting the rotation shaft; and a cylinder sleeve, wherein the cylinder is disposed in the cylinder sleeve and driven to be rotated by the rotation shaft.

Some embodiments of the disclosure provide a heat exchange apparatus, including the above piston limiting structure.

In some embodiments, the heat exchange apparatus is an air conditioner.

Some embodiments of the disclosure have at least one of the following beneficial effects.

In the piston limiting structure provided by some embodiments of the disclosure, the cylinder, the piston and the limiting member are included, the cylinder has a piston hole perpendicular to an axial direction of the cylinder and penetrating through the cylinder, a projection of the piston hole in a penetrating direction is circular, the piston is disposed in the piston hole in a form-fit manner and is reciprocated to be slid in the piston hole, the circular piston and the circular piston hole are used, a manufacturability of the piston and the cylinder is good, a machining is convenient, a machining accuracy is guaranteed, a large-scale production is easy, and a distance from the piston hole of the cylinder to the end face of the cylinder is a uniform transition which is similar to an arch bridge structure, the structure is firmer and not easy to be deformed, at the same time, the circular piston is cooperated with the circular piston hole of the cylinder, it is beneficial to control an assembly clearance between the piston and the cylinder, and beneficial to reduce friction power and leakage, thereby a performance of the piston compressor is improved.

In the piston limiting structure provided by some embodiments of the disclosure, the side wall of the piston is provided with the limiting surface, the limiting surface does not penetrate two ends of the side wall of the piston along an axial length of the piston, an avoidance groove does not exist between the piston and the inner wall of the cylinder, the limiting surface is not communicated with a volume chamber, and a clearance volume does not be introduced, so that the rotary cylinder compressor is worked more stably.

In the piston limiting structure provided by some embodiments of the disclosure, the cylinder is provided with a limiting hole penetrating from an outer wall of the cylinder to the piston hole, the limiting member is disposed in the limiting hole in the form-fit manner, the limiting member abuts against the limiting surface to limit the rotation of the piston around an axis of the piston itself. The limiting member mounted on the cylinder is arranged to be cooperated with the limiting surface on the piston, an assembly of workpieces is convenient, the machining production is easy, and a matching size between the piston and the cylinder is reduced, so a fit clearance between the piston and the cylinder is effectively controlled, a friction power consumption between the piston and the cylinder is reduced, and the performance of the compressor is improved.

In the piston limiting structure provided by some embodiments of the disclosure, the limiting hole penetrates from the end face of the cylinder to the piston hole and is parallel to the axial direction of the cylinder, the limiting hole and the limiting member of the cylinder are arranged in a vertical direction, and the limiting member does not interfere the rotation of the cylinder, so that the rotation of the cylinder is more stable and reliable.

In the piston limiting structure provided by some embodiments of the disclosure, the limiting hole is disposed in a position of ½ of the piston hole along the axial direction of the piston hole, while the piston is reciprocated to be slid in the piston hole, it is satisfied: $L1-L2 \geq S$, herein, the L1 is the length of the limiting surface along the axial direction of the piston, the L2 is the length of the limiting member along the axial direction of the piston, and the S is the stroke of the piston slid in the cylinder. The length of the limiting surface is greater than a total sum of the limiting member and piston stroke lengths, thereby it is guaranteed that the piston does not collide the limiting member while being reciprocated to be slid, a stability and a reliability are guaranteed.

In the piston limiting structure provided by some embodiments of the disclosure, the limiting surface is a plane, the machining and assembly of the limiting surface are convenient, and it is guaranteed that the machining accuracy is higher. The limiting surface is disposed in a position of ½ of a radial height of the piston, while the limiting member abuts against the limiting surface, it is satisfied:

$$\frac{D_1 + D_2}{2} > L > \frac{D_1 - D_2}{2},$$

wherein, the D1 is a diameter of the piston, the D2 is a length of the limiting member in the radial direction of the piston, and the L is a length from a center of the limiting member in the radial direction of the piston to a center of the piston. While it is satisfied that $$\frac{D_1 + D_2}{2} > L,$$

a part of the limiting member abuts against the limiting surface, thereby the piston is limited. While it is satisfied that $$L > \frac{D_1 - D_2}{2},$$

a part of an acting end, abutting against the limiting surface, of the limiting member abuts against an inner wall of the limiting hole, and a part abuts against the limiting surface, the limiting member has no cantilever portion, a force to the limiting member indirectly acts on the cylinder while the piston is rotated on its own axis, a stress subjected to the limiting member is reduced, a strength requirement to the limiting member is reduced, and a work stability and reliability of the compressor are improved.

In the piston limiting structure provided by some embodiments of the disclosure, the limiting hole is extended to a position of ½ of an axial height of the cylinder from the end face of the cylinder, if the length of the limiting member is increased, an abutting area between the limiting member and the limiting surface is larger, an intensity of pressure of an abutting portion is small, and it is not easy to deform, and one or more limiting holes is arranged, so that a limiting effect is better.

In the piston limiting structure provided by some embodiments of the disclosure, the limiting member includes the cylindrical limiting pin, the pin is simple in machining, low in cost, easy to guarantee the accuracy, at the same time, a contact area between the pin and the piston limiting surface is small, a friction force to sliding of the piston is smaller, and sliding interference to a reciprocating motion of the piston is small, so that the compressor is worked more stably.

In the compressor provided by some embodiments of the disclosure, the compressor includes a rotation shaft, the above piston limiting structure and the cylinder sleeve, the cylinder and the piston are provided with the shaft holes penetrating along the axial direction of the cylinder, the cylinder is disposed in the cylinder sleeve and driven to be rotated by the rotation shaft, because the compressor has the above piston limiting structure, it has all of the above beneficial effects.

In the heat exchange apparatus provided by some embodiments of the disclosure, the above piston limiting structure is included, so the heat exchange apparatus has all of the above beneficial effects.

BRIEF DESCRIPTION OF THE DRAWINGS

In order to more clearly describe specific implementation modes of the disclosure or technical schemes in the art known to inventors, drawings to be used in descriptions of the specific implementation modes or the art known to inventors are briefly introduced below. Apparently, the drawings in the following descriptions are some of the implementation modes of the disclosure, and other drawings may also be obtained by those of ordinary skill in the art without creative work according to these drawings.

DETAILED DESCRIPTION OF THE EMBODIMENTS

Figure 1:
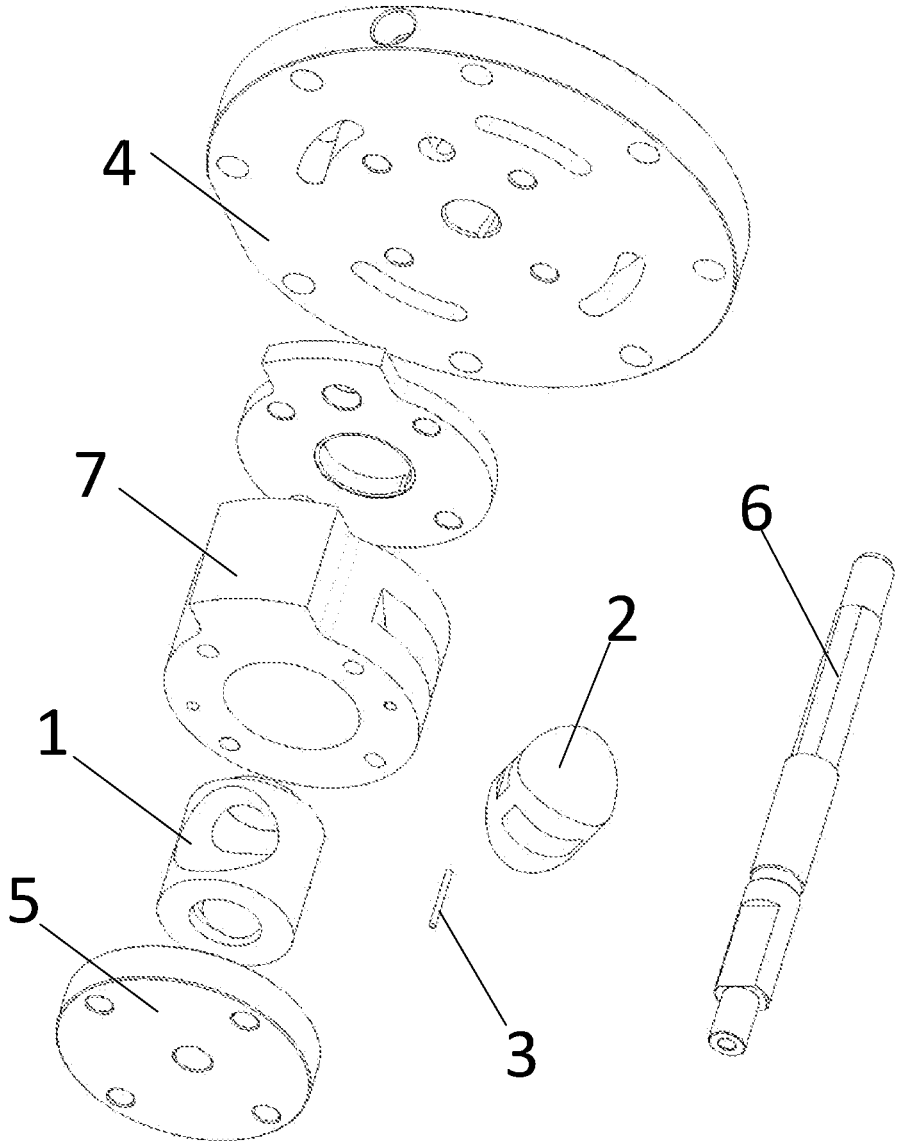
FIG. 1 is an exploded schematic diagram of a compressor in some embodiments provided by the disclosure.

Technical schemes of the disclosure are clearly and completely described below in combination with drawings. Apparently, described embodiments are a part of the embodiments of the disclosure, not all of the embodiments. Based on the embodiments in the disclosure, all other embodiments obtained by those of ordinary skill in the art without creative work shall fall within a scope of protection of the disclosure. In addition, technical features involved in the different embodiments of the disclosure described below may be combined with each other as long as there is no conflict between them.

A rotary cylinder piston compressor in an art known to inventors includes a flange, a cylinder sleeve, a cylinder, a piston and a rotation shaft, based on a crosshead shoe principle, the piston is reciprocated to be slid relative to the cylinder during a rotation process, thereby two ends of the piston form a compression chamber and an exhaust chamber with the cylinder and the cylinder sleeve, respectively. For the piston of the rotary cylinder piston compressor, a degree of freedom of auto-rotation of the piston around an axis of the piston itself needs to be limited. The piston limiting structure provided by some embodiments of the disclosure is used for the rotary cylinder piston compressor in the art known to inventors, thereby it is achieved that the piston is limited. FIG. 1 to FIG. 6 show some embodiments of the piston limiting structure of the disclosure.

The piston limiting structure provided by some embodiments of the disclosure includes a cylinder 1, a piston 2 and a limiting member 3. As shown in FIG. 1 to FIG. 6, in some embodiments, the cylinder 1 is a cylindrical cylinder, an axial direction of the cylinder 1 is provided with an assembling hole 12 penetrating through the cylinder 1, and the assembling hole 12 is configured for a rotation shaft 6 to pass through. A peripheral surface of the cylinder 1 is provided with a piston hole 11 perpendicular to a direction of the assembling 12 and penetrating the cylinder 1, and a projection of the piston hole 11 along an axial direction itself is circular.

Figure 4A:
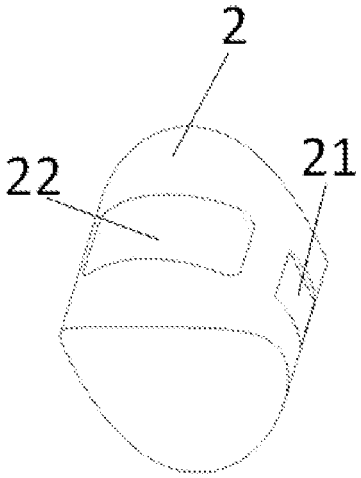
FIG. 4A and FIG. 4B are schematic structure diagrams of a piston in some embodiments provided by the disclosure.
Figure 4B:
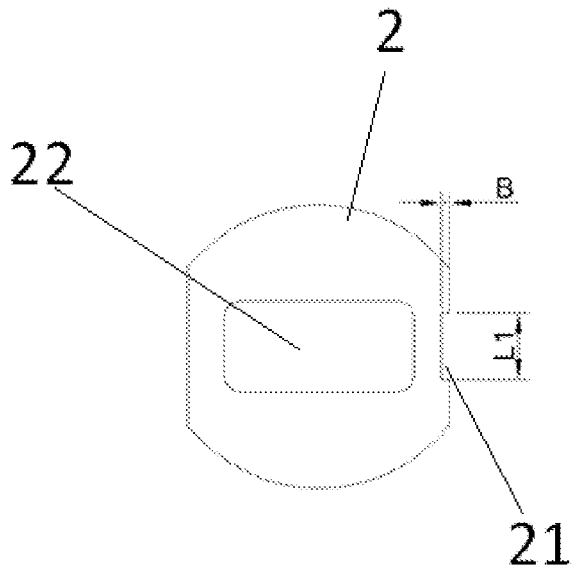

As shown in FIG. 4A and FIG. 4B, the piston 2 is disposed in the piston hole 11 in a form-fit manner and is reciprocated to be slid in the piston hole 11. The piston 2 is cooperated with the piston hole 11, the piston 2 is a structure similar to a cylinder, end faces at two ends of the piston 2 are curved surface structures which are cooperated with the piston hole 11 to form a completed cylindrical surface, an axial length of the piston 2 is less than a radial size of the cylinder 1, and the piston 2 is reciprocated to be slid in the cylinder 1. A middle portion of the piston 2 is provided with a shaft hole 22 along an axial direction of the cylinder 1, while the piston 2 is mounted in the piston hole 11, the rotation shaft 6 passes through the assembling hole 12 of the cylinder 1 and the shaft hole 22 on the piston 2. A side wall of the piston 2 is provided with a limiting surface 21, and the limiting surface 21 does not penetrate two ends of the side wall of the piston 2 along an axial length of the piston 2. As shown in FIG. 4A and FIG. 4B, in some embodiments, the limiting surface 21 is set as a limiting plane, it is convenient for machining and forming, at the same time, the limiting surface 21 is disposed on a position of ½ of a radial height direction of the piston 2.

Figure 3:
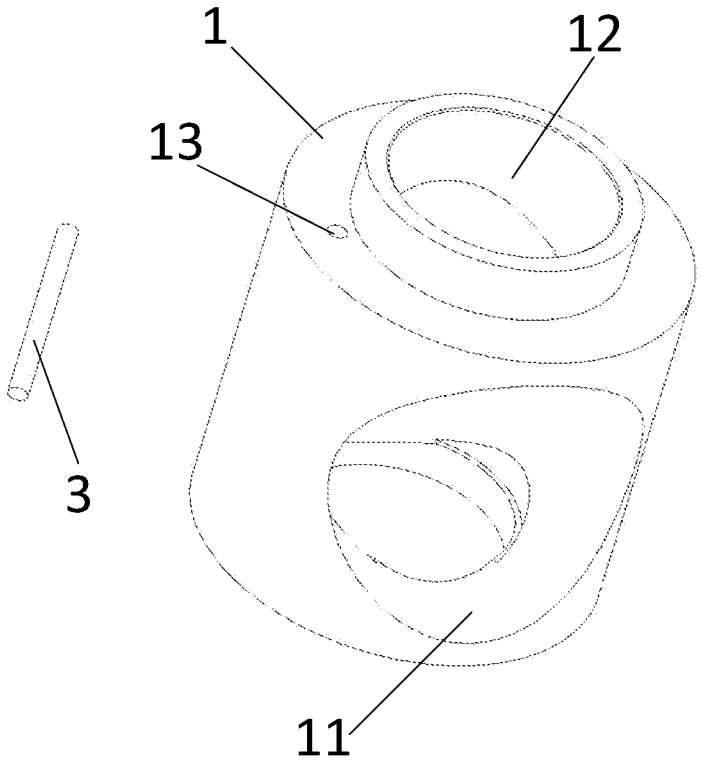
FIG. 3 is a schematic structure diagram of a cylinder in some embodiments provided by the disclosure.

The cylinder 1 is provided with a limiting hole 13 penetrating from an outer wall of the cylinder 1 to the piston hole 11, the limiting member 3 is mounted in the limiting hole 13 in a form-fit manner, the limiting member 3 abuts against the limiting surface 21 to limit the auto-rotation of the piston 2. As shown in FIG. 3, in some embodiments, the limiting hole 13 penetrates from an end face of the cylinder 1 to the piston hole 11 and is parallel to an axial direction of the cylinder 1, the limiting hole 13 is arranged in a vertical direction of the cylinder 1, so that the limiting member 3 abuts against the limiting surface 21 in the vertical direction, machining and forming of the limiting hole 13 are convenient, and an abutting direction is perpendicular to a rotation direction of the cylinder 1 and the piston 2, the limiting member 3 is not subjected to a rotation torque in a horizontal direction, the limiting structure is more stable and reliable. At the same time, in some embodiment, for convenient machining and forming and accuracy guarantee of the limiting member 3, the limiting hole 13 is set as a circular hole, correspondingly the limiting member 3 is set as a cylindrical pin structure, a circular pin is cooperated with the limiting hole 13, for example, a fit clearance between two parties is set as 0-0.05 mm. A position of the limiting hole 13 on the cylinder 1 corresponds to a position of ½ of an axial direction of the piston hole 11, namely the limiting hole 13 is mounted in a middle position of the piston hole 11 along a length direction.

Figure 6:
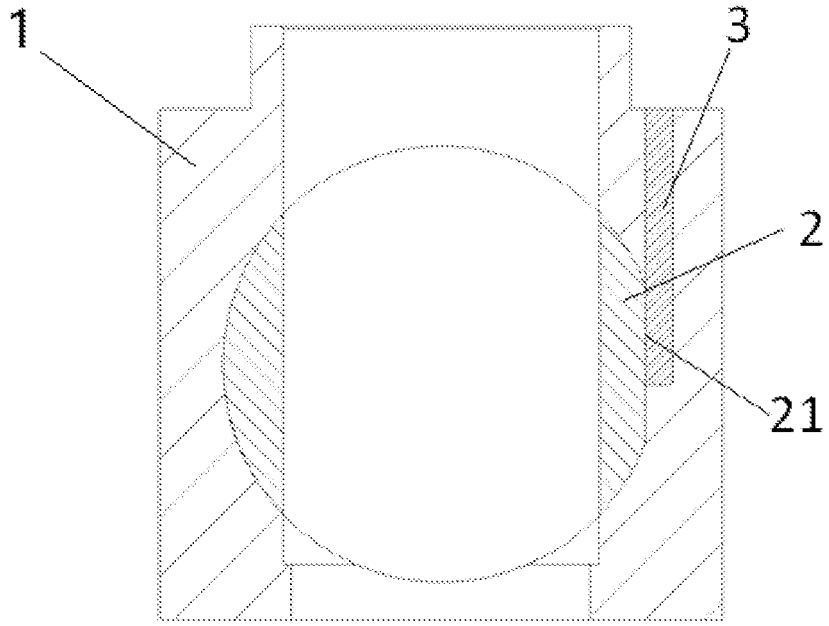
FIG. 6 is a sectional view of a limiting member and a piston assembly in one embodiment provided by the disclosure.

As shown in FIG. 6, while the piston 2, the cylinder 1 and the limiting member 3 are assembled, the piston 2 is assembled in the piston hole 11, the limiting member 3 is inserted in the limiting hole 13 of the cylinder 1, at this moment, the limiting member 3 abuts against the limiting surface 21 of the piston 2, thereby the piston 2 is reciprocated to be slid in the piston hole 11, but the piston 2 is limited to be auto-rotated.

In some embodiments, under a working state, the piston 2 is reciprocated relative to the limiting member 3, thereby in order to guarantee that the piston 2 may not collide with the limiting member 3 during a process of a reciprocating motion, while the piston 2 is reciprocated to be slid in the piston hole 11, it is satisfied:

$$L1-L2 \geq S$$

Herein, as shown in FIG. 4A, FIG. 4B, FIG. 5A and FIG. 5B, the L1 is a length of the limiting surface 21 along an axial direction of the piston 2, and the L2 is a length of the limiting member 3 along the axial direction of the piston 2, in some embodiments, the L2 is a diameter of a cross section of the limiting member 3, and the S is a stroke of the piston slid in the cylinder.

While L1−L2=S, and the piston 2 is slid to a destination position of the stroke in the piston hole 11, a side wall of a sink groove formed by the limiting surface 21 on the piston 2 and the limiting member 3 are positioned in a limit position in which they just do not contact with each other, at this moment, the piston 2 does not collide with the limiting member 3. While L1−L2>S, and the piston 2 is reciprocated to be slid in the piston hole 11, the side wall of the sink groove formed by the limiting surface 21 on the piston 2 always does not contact with the limiting member 3, therefore the piston 2 does not collide with the limiting member 3, and the compressor is worked more stably and reliably.

On this basis, it can be seen that the length L2 of the limiting member 3 along the axial direction of the piston 2 is longer, correspondingly the length L1 of the limiting surface 21 is also designed to be longer, therefore the length of the limiting surface 21 is reduced by reducing the length of the limiting member 3 along the axial direction of the piston 2, the length of the limiting surface 21 is reduced, correspondingly a sealing distance between the piston 2 and the inner wall of the cylinder 1 becomes longer, so that a sealing effect between the piston 2 and the inner wall of the cylinder is better. At the same time, under a precondition of satisfying a minimum sealing distance requirement, diameters of the piston 2 and the cylinder 1 are correspondingly designed to be reduced, therefore the mechanical power consumption of the compressor is reduced.

In some embodiments, in order to guarantee that an abutting relation exists between the limiting member 3 and the limiting surface 21 of the piston 2, it is satisfied by the setting of the limiting hole 13 that:

$$\frac{D_1 + D_2}{2} > L$$

Figure 5A:
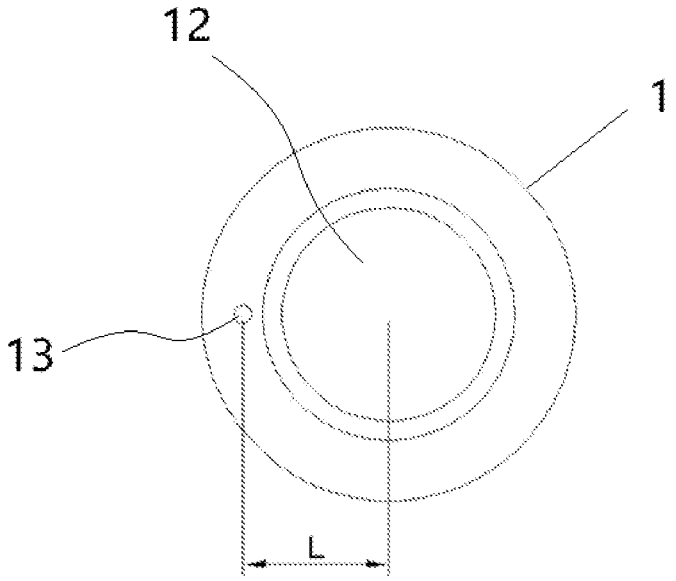
FIG. 5A and FIG. 5B are a top view and a sectional view of a cylinder in some embodiments provided by the disclosure.
Figure 5B:
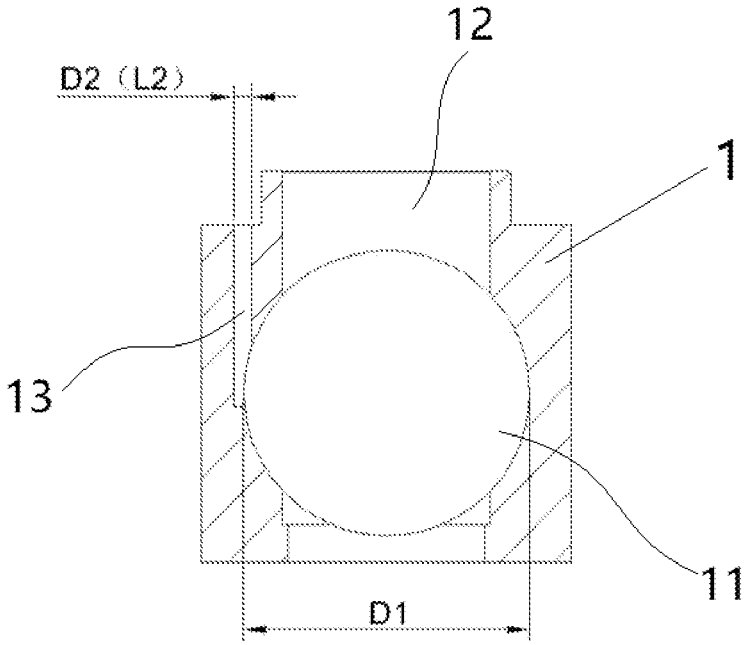

Herein, as shown in FIG. 5A and FIG. 5B, the D1 is a diameter of a cross section of the piston 2, and the D2 is a length of the limiting member 3 in a radial direction of the piston 2, in some embodiments, D2 is a diameter of a section of the limiting member 3, and the L is a length from a center of the limiting member 3 in the radial direction of the piston 2 to a center of the piston 2, while the limiting member 3 abuts against the limiting surface 21, L=(D1+D2)/2−B, herein the B is a depth of the sink groove formed by the limiting surface 21 on the piston 2.

While $$\frac{D_1 + D_2}{2} = L,$$

the limiting member 3 and the piston 2 are positioned in a critical state of non-contact, at this moment, the abutting relation does not exist between the limiting member 3 and the piston 2, therefore the piston 2 does not be limited. While $$\frac{D_1 + D_2}{2} > L,$$

at this moment, the limiting member 3 abuts against the limiting surface 21, thereby limiting an auto-rotation of the piston 2.

At the same time, on this basis, in order to guarantee that a bottom portion of the limiting member 3 is not suspended in the air (abutting against the cylinder 1) while the limiting member 3 is mounted in the limiting hole 13, while the limiting member 3 abuts against the limiting surface 21, it should also be satisfied:

$$L > \frac{D_1 - D_2}{2}$$

While $$L = \frac{D_1 - D_2}{2},$$

the limiting member 3 is mounted in the limiting hole 13, a bottom end face of the limiting member 3 and a bottom portion of the limiting hole 13 are positioned in the critical state of non-contact, at this moment, the limiting member 3 is a cantilever structure, an upper end of the limiting member 3 needs to be fixed and limited. While $$L > \frac{D_1 - D_2}{2},$$

a part of the bottom end face of the limiting member 3 abuts against the bottom portion of the limiting hole 13, the limiting member 3 has no cantilever structure, a force to the limiting member 3 indirectly acts on the cylinder 1 while the piston 2 has a tendency to the auto-rotation, a stress to the limiting member 3 is reduced, and a strength requirement to the limiting member is reduced.

As shown in FIG. 6, in some embodiments, the limiting hole 13 is extended to a position of ½ of an axial height of the cylinder 1 along an end face of the cylinder 1, and a length of the limiting member is increased, so that an abutting area between the limiting member and the limiting surface is larger, a pressure intensity of an abutting portion is small, and it is not easy to be deformed.

Structures and principles of the piston limiting structure in some embodiments are described above, it is to be noted that, on the basis of the above embodiments, the disclosure also has other replaceable embodiments.

Figure 7:
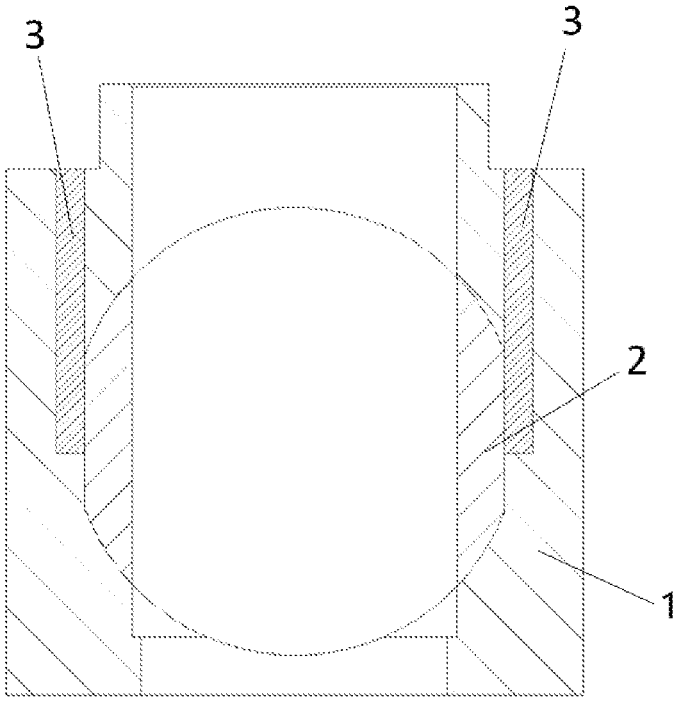
FIG. 7 is a sectional view of a limiting member and a piston assembly in a second embodiment provided by the disclosure.

FIG. 7 shows a second implementation mode of the piston limiting structure of the disclosure, in the embodiments, a difference from the above embodiments is that the number of the limiting members 3 is set as two, correspondingly two corresponding limiting holes 13 are arranged on the cylinder 1, the two limiting members 3 are respectively arranged on an upper end face of the cylinder 1 and positioned at two sides of an axis of the cylinder 1, the piston 2 is limited by the two limiting members 3, limiting reliability is improved, implementation parameters and limiting principles thereof are the same as the above embodiments, it is not repeatedly described in the implementation mode.

Figure 8:
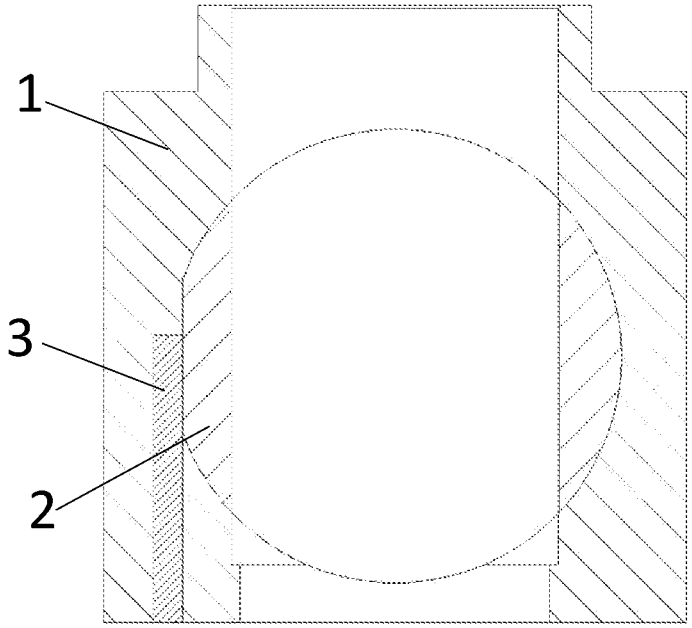
FIG. 8 is a sectional view of a limiting member and a piston assembly in a third embodiment provided by the disclosure.

FIG. 8 shows a third embodiment of the piston limiting structure of the disclosure, in the embodiment, a difference from the above embodiments is that the limiting hole 13 is disposed at one side of a lower end face of the cylinder 1, implementation parameters and limiting principles are the same as the above embodiments.

Figure 9:
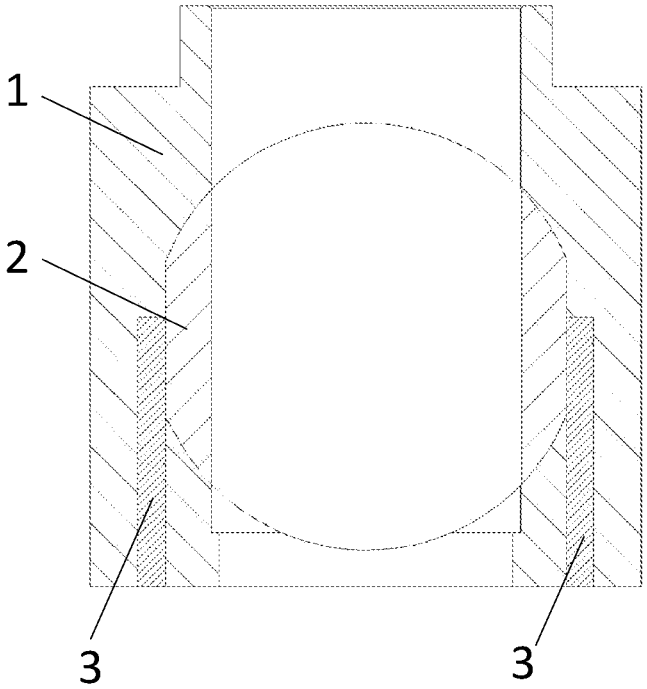
FIG. 9 is a sectional view of a limiting member and a piston assembly in a fourth embodiment provided by the disclosure.

FIG. 9 shows a fourth embodiment of the piston limiting structure of the disclosure, in the embodiment, two limiting holes 13 are arranged, and the two limiting holes 13 are respectively disposed at two sides of the axis of the lower end face of the cylinder 1, implementation parameters and limiting principles are the same as the above embodiments.

Figure 10:
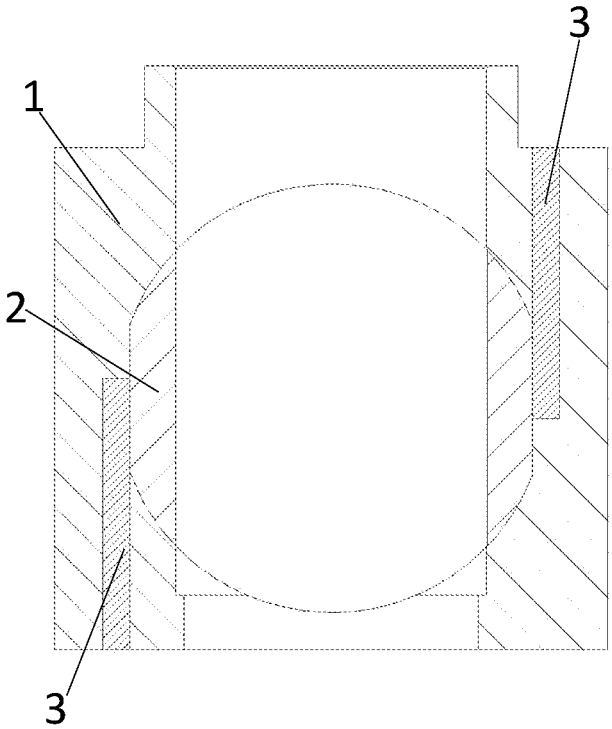
FIG. 10 is a sectional view of a limiting member and a piston assembly in a fifth embodiment provided by the disclosure.

FIG. 10 shows a fifth embodiment of the piston limiting structure of the disclosure, in the embodiment, two limiting holes 13 are arranged, and the two limiting holes 13 are respectively disposed on the upper and lower end faces of the cylinder 1, and the two limiting holes 13 are respectively positioned at two sides of the axis of the cylinder 1, implementation parameters and limiting principles are the same as the above embodiments.

Figure 11:
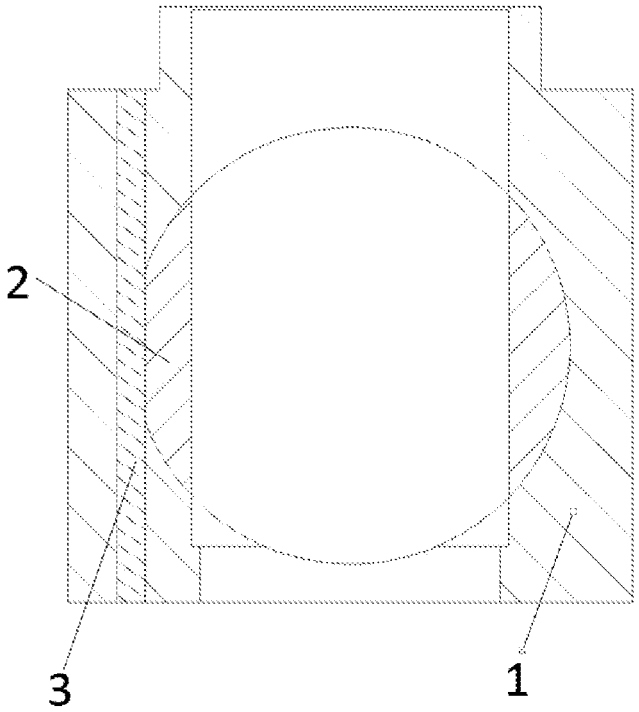
FIG. 11 is a sectional view of a limiting member and a piston assembly in a sixth embodiment provided by the disclosure.

FIG. 11 shows a sixth embodiment of the piston limiting structure of the disclosure, in the embodiment, the limiting hole 13 penetrates the upper and lower end faces of the cylinder 1, the limiting member 3 is correspondingly disposed in the limiting hole 13, an axial length of the limiting member 3 is less than or equal to an axial length of the cylinder 1 and greater than a half of the axial length of the cylinder 1, implementation parameters and limiting principles are the same as the above embodiments.

Figure 12:
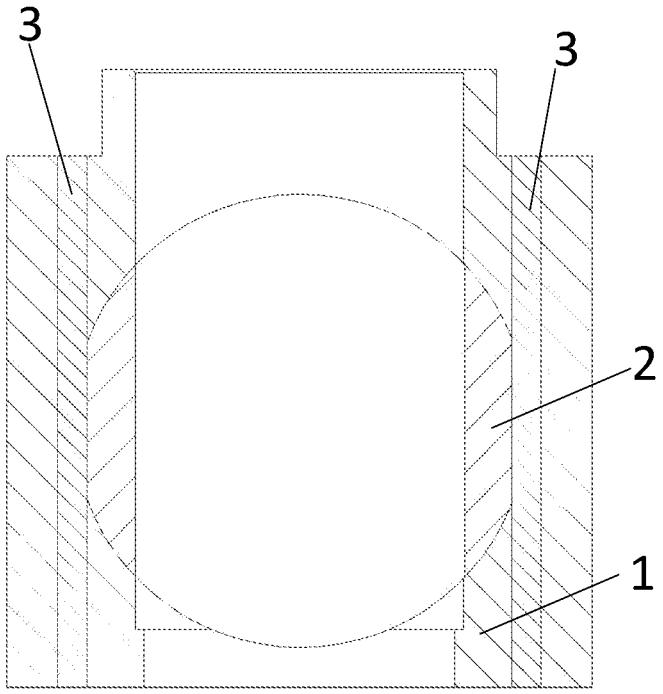
FIG. 12 is a sectional view of a limiting member and a piston assembly in a seventh embodiment provided by the disclosure.

FIG. 12 shows a seventh embodiment of the piston limiting structure of the disclosure, in the embodiment, the limiting hole 13 penetrates the upper and lower end faces of the cylinder 1, and two limiting holes 13 are arranged, and respectively positioned at two sides of the axis of the cylinder 1, each of the limiting members 3 is arranged in the corresponding limiting hole 13, the axial length of the limiting member 3 is less than or equal to the axial length of the cylinder 1 and greater than a half of the axial length of the cylinder 1, implementation parameters and limiting principles are the same as the above embodiments.

In other embodiments, the limiting member 3 may also be other arbitrary shapes suitable for implementation, for example, a cube, a plate shape and a column shape, this is not limited by the disclosure.

Figure 2:
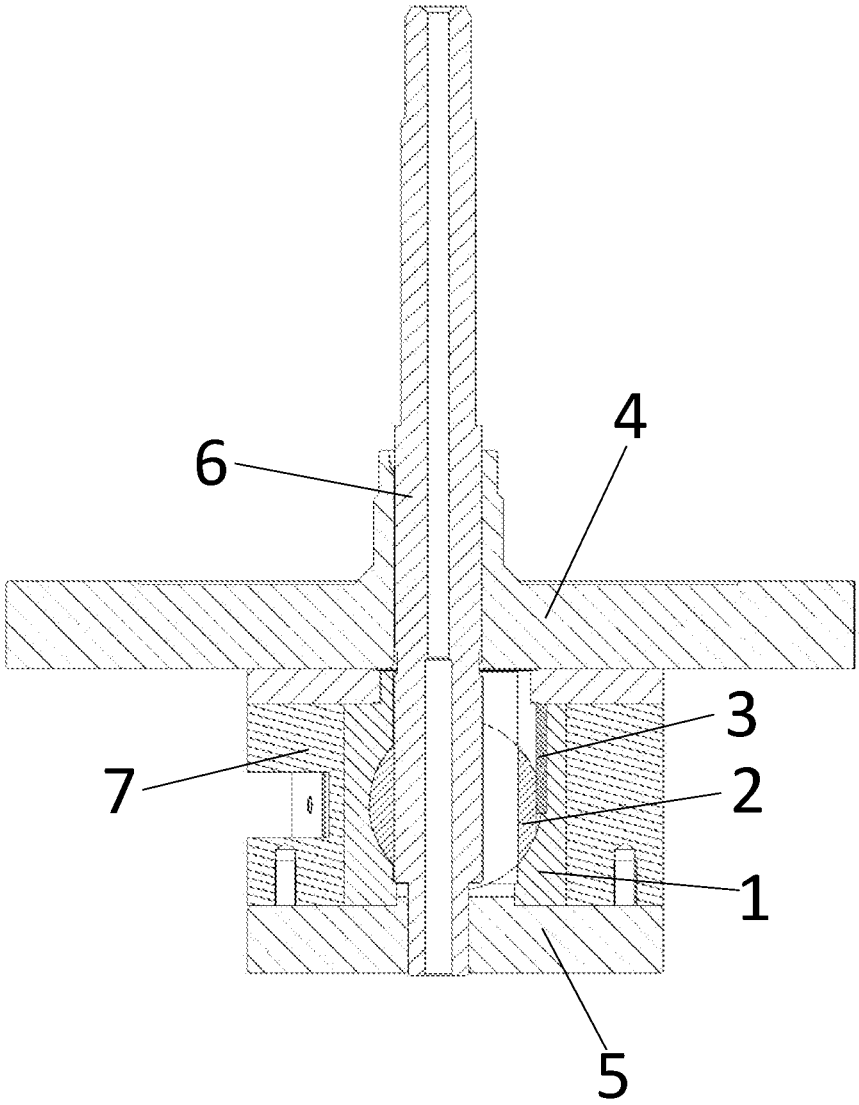
FIG. 2 is an assembly structure section view of the compressor in some embodiments provided by the disclosure.

In some embodiments, the disclosure further provides a compressor, as shown in FIG. 1, the compressor of some embodiments of the disclosure includes a rotation shaft 6, an upper flange 4, a lower flange 5, a cylinder sleeve 7, and the above piston limiting structure, the cylinder 1 is disposed in the cylinder sleeve 7, the rotation shaft 6 successively penetrates the upper flange 4, the cylinder sleeve 7, and the lower flange 5. The compressor of the embodiments of the disclosure is based on the crosshead shoe principle, as shown in FIG. 2, while the compressor is worked, the rotation shaft 6 abuts against a wall surface of the shaft hole 22 of the piston hole 2, so that the piston 2 and the cylinder 1 are driven to be rotated in the cylinder sleeve 7, and because of eccentric rotation of the rotation shaft 6 and the cylinder 1, the piston 2 reciprocates relative to the cylinder 1, thereby a gas is compressed in a volume chamber at two ends of the piston 2. In some embodiments of the disclosure, through setting cooperation limiting of the limiting member 3 and the limiting surface 21 of the piston 2, a problem that collision to the cylinder due to the auto-rotation of the piston of the compressor is effectively avoided.

Some embodiments of the disclosure further provide a heat exchange apparatus, and the heat exchange apparatus includes the above compressor or piston limiting structure. The heat exchange apparatus is an air conditioner or a refrigerator.

Apparently, the above embodiments are merely examples for clear description, and are not intended to limit the implementation modes. Other changes or modifications in different forms are made on the basis of the above description by those of ordinary skill in the art. There is no need and may not be an exhaustive list of all of the embodiments. The apparent changes or modifications derived from this are still within a scope of protection of the present disclosure.

What is claimed is:

1. A piston limiting structure, comprising:

a cylinder, having a piston hole perpendicular to an axial direction of the cylinder and penetrating the cylinder, wherein a projection of the piston hole in a penetrating direction is circular;

a piston, disposed in the piston hole in a form-fit manner and slid in the piston hole in a reciprocating manner, wherein a side wall of the piston is provided with a limiting surface, and the limiting surface does not penetrate through two ends of the side wall of the piston along an axial direction of the piston;

a limiting member, wherein the cylinder is provided with a limiting hole passing from an outer wall of the cylinder to the piston hole, the limiting member is mounted in the limiting hole in the form-fit manner, and the limiting member abuts against the limiting surface to limit a rotation of the piston around its own axis; and the limiting hole penetrates from an end face of the cylinder to the piston hole and is parallel to an axial direction of the cylinder.

2. The piston limiting structure as claimed in claim 1, wherein, a position of the limiting hole on the cylinder corresponds to a position of ½ of an axial length of the piston hole.

3. The piston limiting structure as claimed in claim 2, wherein, while the piston is reciprocated to be slid in the piston hole, it is satisfied:

$$L1-L2\geq S$$

wherein, the L1 is a length of the limiting surface along the axial direction of the piston, the L2 is a length of the limiting member along the axial direction of the piston, and the S is a stroke of the piston slid in the cylinder.

4. The piston limiting structure as claimed in claim 2, wherein, the limiting surface is a plane, wherein the limiting surface is disposed in a position of ½ of a radial height direction of the piston.

5. The piston limiting structure as claimed in claim 4, wherein, while the limiting member abuts against the limiting surface, it is satisfied:

$$\frac{D_1+D_2}{2}>L$$

wherein, the D1 is a diameter of a projection of the piston in the axial direction, the D2 is a length of the limiting member in a radial direction of the piston, and the L is a length from a center of the limiting member in the radial direction of the piston to a center of the piston.

6. The piston limiting structure as claimed in claim 5, wherein, while the limiting member abuts against the limiting surface, it is satisfied:

$$L>\frac{D_1-D_2}{2}$$

wherein, the D1 is the diameter of the projection of the piston along the axial direction, the D2 is the length of the limiting member in the radial direction of the piston, and the L is the length from the center of the limiting member in the radial direction of the piston to the center of the piston.

7. The piston limiting structure as claimed in claim 1, wherein, the limiting hole is extended to a position of ½ of an axial height of the cylinder from the end face of the cylinder.

8. The piston limiting structure as claimed in claim 7, wherein, the number of the limiting hole is one, and the limiting hole is disposed on an upper end face or a lower end face of the cylinder.

9. The piston limiting structure as claimed in claim 7, wherein, the number of the limiting holes is two, two limiting holes are disposed on an upper end face of the cylinder and positioned at two sides of an axis of the cylinder, or two limiting holes are disposed on a lower end face and positioned at two sides of an axis of the cylinder, or one of two limiting holes is disposed on an upper end face of the cylinder and positioned at one side of an axis of the cylinder, and the other of the two limiting holes is disposed on a lower end face of the cylinder and positioned at the other side of the axis of the cylinder.

10. The piston limiting structure as claimed in claim 6, wherein, the limiting hole penetrates through the cylinder, and is disposed in at least one side of two sides of the axis of the cylinder.

11. The piston limiting structure as claimed in claim 1, wherein the limiting member comprises a cylindrical limiting pin.

12. A compressor, comprising:

a rotation shaft;

the piston limiting structure as claimed in claim 1, wherein the cylinder and the piston are provided with shaft holes penetrating along an axial direction of the cylinder, the shaft holes are used for mounting the rotation shaft; and a cylinder sleeve, wherein the cylinder is disposed in the cylinder sleeve and driven to be rotated by the rotation shaft.

13. A heat exchange apparatus, comprising the piston limiting structure as claimed in claim 1.

14. The heat exchange apparatus as claimed in claim 13, wherein the heat exchange apparatus comprises an air conditioner.

15. The piston limiting structure as claimed in claim 3, wherein, the limiting surface is a plane, wherein the limiting surface is disposed in a position of ½ of a radial height direction of the piston.

16. The compressor as claimed in claim 12, wherein the limiting hole penetrates from an end face of the cylinder to the piston hole and is parallel to an axial direction of the cylinder.

17. The compressor as claimed in claim 16, wherein a position of the limiting hole on the cylinder corresponds to a position of ½ of an axial length of the piston hole.

18. The compressor as claimed in claim 17, wherein while the piston is reciprocated to be slid in the piston hole, it is satisfied:

$$L1-L2 \geq S$$

wherein, the L1 is a length of the limiting surface along the axial direction of the piston, the L2 is a length of the limiting member along the axial direction of the piston, and the S is a stroke of the piston slid in the cylinder.

19. The compressor as claimed in claim 16, wherein the limiting surface is a plane, wherein the limiting surface is disposed in a position of ½ of a radial height direction of the piston.

* * * * *